United States Patent [19]

Ingalls

[11] 4,142,130

[45] Feb. 27, 1979

[54] MULTIFLASH OPERATING CIRCUIT DIRECTLY COUPLED TO AC SOURCE

[75] Inventor: Jeffrey D. Ingalls, Ipswich, Mass.

[73] Assignee: GTE Sylvania Incorporated, Stamford, Conn.

[21] Appl. No.: 865,564

[22] Filed: Dec. 29, 1977

[51] Int. Cl.[2] ..... H05B 41/34; H05B 41/16

[52] U.S. Cl. ..... 315/188; 315/189; 315/200 R; 315/232; 315/241 R; 315/250; 315/324

[58] Field of Search ..... 315/185 R, 186–190, 315/200 A, 200 R, 228, 232, 250, 261, 241 R, 241 S, 241 P, 323, 324, 335, 337

[56] References Cited

U.S. PATENT DOCUMENTS

| | | | |
|---|---|---|---|
| 3,031,599 | 4/1962 | Paschke et al. | 315/241 S X |
| 4,041,351 | 8/1977 | Whitehouse et al. | 315/335 X |

FOREIGN PATENT DOCUMENTS

| | | | |
|---|---|---|---|
| 1292136 | 3/1969 | Fed. Rep. of Germany | 315/241 R |

*Primary Examiner*—Eugene R. LaRoche
*Attorney, Agent, or Firm*—Edward J. Coleman

[57] ABSTRACT

A circuit for efficiently operating two arc discharge flashlamps. The lamps are series connected and directly coupled through series circuitry across an alternating current (AC) source. A storage capacitor is connected between the junction of the lamps and one terminal of the source. Trigger pulses are alternately applied to the lamps so that the storage capacitor is charged when one lamp flashes and discharged when the other lamp flashes. RC timing circuits energized by the AC source control the time of pulsed ignition of respective lamps with respect to the phase of the AC waveform of the source.

8 Claims, 2 Drawing Figures

MULTIFLASH OPERATING CIRCUIT DIRECTLY COUPLED TO AC SOURCE

CROSS-REFERENCE TO RELATED APPLICATIONS

Ser. No. 775,122, filed Mar. 7, 1977, now U.S. Pat. No. 4,095,140, Ellison H. Kirkhuff et al, "Trigger Circuit for Flash Lamp Directly Coupled to AC Source", assigned the same as this invention.

Ser. No. 865,405, filed concurrently herewith, Ellison H. Kirkhuff et al, "Multiflash Operating Circuit", assigned the same as this invention.

Ser. No. 865,404, filed concurrently herewith, Robert J. Cosco et al, "Multiflash System", assigned the same as this invention.

BACKGROUND OF THE INVENTION

This invention relates generally to electrical circuits for operating arc discharge flashlamps and, more particularly, to a more efficient circuit for operating a plurality of flashlamps which are directly coupled to an alternating current (AC) source.

Such flashlamps are employed in a variety of applications; for example, flash photography; reprographic machines; laser excitation; and warning flashers for airplanes, towers, road barriers, marine equipment and tower mounted approach lighting systems for airport runways.

Flash lamps of the type referred to herein generally comprise two spaced apart electrodes within an hermetically sealed glass envelope having a rare gas fill, typically xenon, at a subatmospheric pressure. In typical prior art operating circuits, such lamps are connected across an energy storage device, such as one or more capacitors, charged to a substantial potential, but insufficient to ionize the xenon gas fill. Upon application of an additional pulse of sufficient voltage, the xenon is ionized and an electric arc is formed between the two electrodes, discharging the storage device through the flash lamp, which emits a burst of intense light. In many cases the pulse voltage is applied between an external trigger electrode, such as a wire wrapped around the envelope, and one of the electrodes; this is referred to as a shunt triggering. However, in other cases an external wire is not feasible since it may result in an undesirable arcing between the trigger wire and a proximate lamp reflector, or else the high potential applied to the external trigger wire might be hazardous to operating personnel. In those cases, the lamp may be internally triggered by applying the pulse voltage directly across the lamp electrodes, a technique referred to as injection triggering. Usually the voltage required is about 30 to 50 percent higher than that required to trigger the same lamp with an external trigger wire, and the trigger transformer secondary must carry the full lamp current.

In applications requiring two (or more) flash lamps, the lamps have been series-connected across the storage capacitor means, with a single injection trigger circuit being used for the series lamp combination. Whether using one lamp or a plurality of lamps, the general operation of the prior flash circuits comprised charging the storage capacitor means, typically through a resistor, to a predetermined level of voltage, then, on command, triggering the lamp (or lamps) into ionization and thereby discharging the capacitor means through the ionized lamp (or lamps). The energy thus developed in the lamp (or set of lamps) is equal to one-half of the capacitance of the storage means multiplied by the square of the charged voltage. Accordingly, this conventional method of operation results in the waste of a considerable amount of energy in charging the storage capacitor means through a power dissipating resistor. Further, time is wasted in "coming up to charge", or the storage capacitor means must be maintained in a fully charged state until called upon to flash the lamp.

One approach for overcoiming the aforementioned shortcomings of conventional flash lamp arrangements is described in the above-referenced copending applications Ser. No. 865,405 of Kirkhuff et al. Briefly, the operating circuit of this copending application uses the charging current of the storage capacitor, as well as the discharge current, for purposes of lamp energization. More specifically, first and second arc discharge flash lamps are series connected across a supply voltage source comprising a large direct current storage bank. The storage capacitor means is connected between the junction of the lamps and one terminal of the source. Respective injection or shunt means are provided for coupling trigger pulses to each lamp, and a succession of high voltage trigger pulses are alternately applied through the respective coupling means to the lamps. Each trigger pulse applied to the first lamp effects an arc path therethrough for charging the capacitor, and each trigger pulse applied to the second lamp effects an arc path therethrough for discharging the capacitor. Hence, the storage capacitor is charged through one lamp and discharged through the other in response to trigger pulses, which are applied in alternate sequence to the lamps. In essence, the lamps function as alternately actuated switches for charging and discharging the capacitor.

The flashes can be synchronized so that the human eye cannot perceive any variation in time between the flashes, e.g., four milliseconds between flashes. Such multiflash capability for predetermined durations is particularly useful for reprographic applications.

Efficiency is significantly increased by the elimination of power dissipating and time consuming charging resistors. The capacitor means delivers approximately twice the normal power to the lamp by virtue of its charging current as well as its discharge current. Accordingly, the capacitance for a given multiflash system in which the charge cycle is used for lamp energization, as well as the discharge cycle, may be approximately one half that required for the storage capacitor of a comparable system (i.e., same voltage and joule rating) employing a conventional resistor charge circuit. As a result, the circuit permits the use of a smaller capacitor with attendant reductions in cost and package size.

Further, the tendency of the arc discharge to hang on is reduced as each lamp functions as a switch, and the buildup of the voltage on the storage capacitor with respect to the source causes the first lamp (during the charge cycle) to extinguish at the proper time. During the discharge cycle, the second lamp extinguishes due to the limited energy capacity of the storage capacitor with respect to the source.

Although offering a number of significant advantages, the above-discussed circuit also has a disadvantage in that the power source requires a large DC storage means, such as a bank of capacitors. This tends to add to the bulk, weight and expense of the DC power source. Such factors detract from efforts to provide compact, low cost photographic flashlamps, or light weight runway flashers for mounting on frangible towers. One approach which has been taken to overcome such disadvantages with respect to the discharge storage bank (not power source) used in single flash lamp circuits is discussed to in the above-referenced copending application Ser. No. 775,122 of Kirkhuff et al, now U.S. Pat. No. 4,095,140. Briefly, the lamp is coupled directly across a conventional AC source to take advantage of the high transient current capacity thereof for flash operation. Triggering is controlled by an RC timing circuit at a predetermined phase of the AC source. This arrangement eliminates the charging resistor and discharge capacitor, but usually a series ballast resistor is required for current limiting, unless the lamp is optimized. Further, this direct line coupled system does not provide all the above-discussed advantages of the multiflash circuit which flashes lamps on both the charge and discharge cycles.

SUMMARY OF THE INVENTION

Accordingly, it is an object of the present invention to provide an improved operating circuit for arc discharge flashlamps.

It is a particular object to economically provide a significantly more efficient operating circuit for a multiflash system which is also more compact and light weight.

These and other objects, advantages and features are attained, in accordance with the principles of the present invention, by using the above-described efficient multiflash arrangement, wherein a pair of flash lamps are alternately triggered to charge and discharge a storage capacitor through the lamps, but connecting that arrangement directly to an AC source. More specifically, a multiflash operating circuit is provided which comprises a pair of series connected arc discharge lamps directly connected across the first and second terminals of an AC source. A storage capacitor means is connected between the junction of the lamps and the second terminal of the AC source. Respective means are provided for coupling trigger pulses to each lamp, and a succession of high voltage trigger pulses are alternately applied through the respective coupling means to the lamps. Each trigger pulse applied to a first one of the lamps effects an arc path therethrough for charging the capacitor means, and each trigger pulse applied to the second lamp effects an arc path therethrough for discharging the capacitor means. Hence, the storage capacitor means is charged through one lamp and discharged through the other in response to trigger pulses which are applied in alternate sequence to the lamps. In this manner, the first lamp draws the major portion of its operating voltage directly from the AC source with no substantial energy storage means located therebetween, other than the storage capacitor means.

The means for generating and alternately applying trigger pulses comprises first and second high voltage pulse generating means connected in respectively opposite orientations across the terminals of the AC source to be energized thereby. The outputs of the pulse generating means are respectively connected to the means for coupling pulses to the lamps. First and second timing circuits are connected in respectively opposite orientations across the terminals of the AC source to be energized thereby, and each timing circuit is coupled to a respective one of the high voltage pulse generating means for controlling the time of pulsed ignition of a respective lamp with respect to the phase of the AC waveform of the source.

The circuit may further include a third timing circuit connected across the AC source to be energized thereby and connected to the first timing circuit for controlling the duration of operation thereof. The third timing circuit thereby controls the duration of the period over which trigger pulses are applied to the first lamp. The third timer also includes a reset switch.

The circuit according to the invention does not require a ballasting resistor, and it eliminates the need for a lamp storage bank as part of the power source. Typically, such DC storage bank sources have been selected to have at least ten times the capacitance of the discharge capacitor. Accordingly, the present circuit significantly reduces the weight, bulk and expense of a multiflash system. Further, the circuit should prevent lamp hold over, as the first lamp (for capacitor charging) is open to the AC source while the second lamp is flashing (discharging the capacitor). The first lamp will extinguish when the difference between source voltage minus the voltage on the charging capacitor is equal to the extinguishing voltage of the first lamp. Efficiency will be high as there is no charging resistor and the lamp current will show capacitive reactance (leading current). The use of multiple lamps with this circuit may provide longer lamp life as power is spread between the plurality of lamps. In this system, the ratio of peak to average power is low; i.e., there are multiple lower energy flashes as compared with one high energy flash of the conventional capacitor discharge system. Further light distribution should be more uniform with multiple lamps.

BRIEF DESCRIPTION OF THE DRAWINGS

This invention will be more fully described hereinafter in conjunction with the accompanying drawings, in which.

DESCRIPTION OF PREFERRED EMBODIMENT

Figures 1, 2:
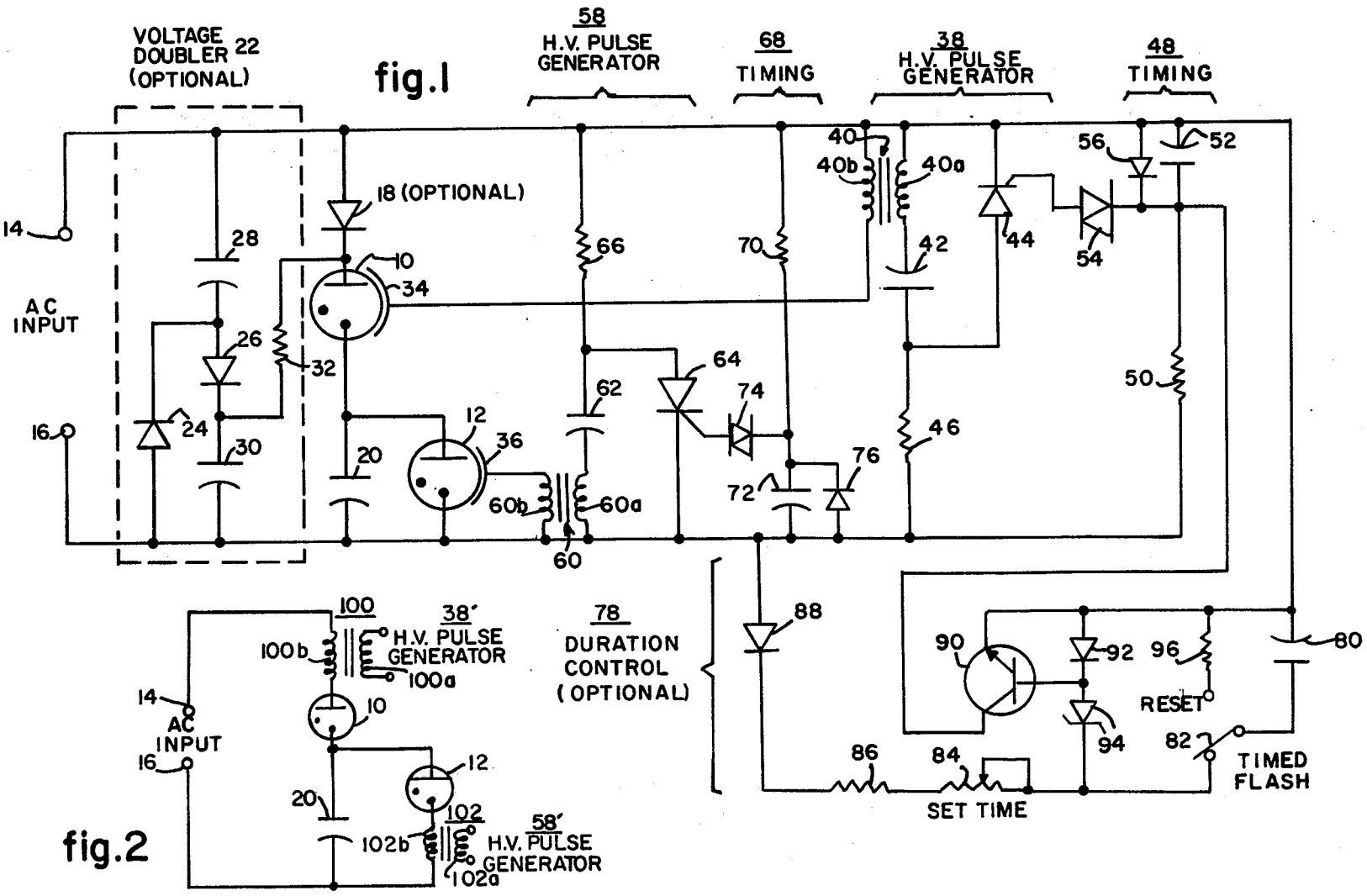
FIG. 1 is a simplified schematic diagram of a multiflash operating circuit according to the invention in which the lamps are shunt triggered.
FIG. 2 is a simplified schematic diagram showing an injection triggering arrangement applied to the multiflash operating circuit of the invention.

In accordance with the present invention, referring to FIG. 1, a pair of arc discharge flash lamps 10 and 12 are series connected across an AC source represented by terminals 14 and 16. The AC source may be a conventional 120 volt, 60 Hertz power line. There is no large DC storage bank of the type employed in the above-referenced copending application Ser. No. 865,405. The anode of lamp 10 is coupled to terminal 14 of the AC source through a series connected diode 18. A storage capacitor means, such as a single capacitor 20, is connected between the junction of lamps 10 and 12 and terminal 16 of the AC source, the cathode of lamp 10 being connected to the anode of lamp 12. In lieu of the illustrated capacitor 20, of course, the storage capacitor means may comprise a bank of two or more capaictors. The cathode of lamp 12 is coupled directly to AC terminal 16, which is the neutral line. With this mode of connecting the two lamps, as will be described in detail hereinafter, flash lamp 10, once ignited, will conduct only during the positive half cycle of the single phase AC power source 14, 16, and lamp 12, once ignited, will conduct only during the negative half cycles of the AC source. Diode 18 is optional and may be employed to assure turn off of lamp 10 during negative half cycles.

Proper lamp selection, however, should preclude the need for diode 18. Preferably both lamps are xenon filled.

The circuit also illustrates the use of a voltage doubler circuit 22 to assure reliable operation of the first lamp 10 without skipping. This, however, is also an optional precaution and may be eliminated with proper lamp selection. The voltage doubler circuit comprises diodes 24 and 26 and capacitors 28 and 30 connected as illustrated across terminals 14 and 16 to be energized by the AC source. The junction of diode 26 and capacitor 30 is connected through a coupling resistor 32 to the anode of lamp 10 to assure the ignition thereof when triggered.

In FIG. 1 the lamps 10 and 12 are shunt triggered through respective external electrodes 34 and 36. Further, in accordance with the invention, lamps 10 and 12 are operated so as to flash in alternate sequence by alternately applying a succession of trigger pulses to the external electrodes 34 and 36, respectively. A variety of high voltage trigger generating circuits may be used for this purpose. FIG. 1 shows a preferred implementation of a circuit arrangement for generating and alternately applying the trigger pulses to external electrodes 34 and 36.

The high voltage pulse generator 38 for lamp 10 comprises a pulse transformer 40, a capacitor 42 and a controlled switching means 44, such as a silicon controlled rectifier (SCR). One side of capacitor 42 is connected through a resistor 46 to AC terminal 16, and the other side of capacitor 42 is connected through the primary winding **40*a* of pulse transformer 40 to AC terminal 14. The secondary winding 40*b* of pulse transformer 40 is connected between AC terminal 14 and the external trigger electrode 34 mounted adjacent to the envelope of flash lamp 10 for capactively coupling pulsed high voltage to the lamp. SCR 44 is connected across capacitor 42 and primary winding 40*a*, with the anode connected to the junction of capacitor 42 and resistor 46 and the cathode connected to AC terminal 14. Hence, when SCR 44 is triggered into conduction, a charge build up on capacitor 42 from the AC source is discharged across primary winding 40*a*. As a result a high voltage pulse is applied to the trigger electrode 34 of lamp 10 from the secondary of pulse transformer 40. This pulsing ionizes the xenon fill gas, and if capacitor 20 is at its minimum charge level and the AC source is in the positive half cycle, the anode to cathode voltage provided by the AC source is sufficient to sustain ionization. Lamp 10 will then conduct heavily to rapidly charge capacitor 20 to peak or near peak of the AC source. When capacitor 20 is fully charged, the voltage across the lamp drops below that necessary to sustain ionization and lamp 10 is reliably extinguished. That is, lamp 10 will extinguish when the difference between the source voltage minus the capacitor 20 voltage is equal to the extinguishing voltage of the lamp. In addition, with diode 18 in the circuit, current flow is stopped when the high side of the line (terminal 14**) goes negative.

For maximum intensity, lamp 10 should be ionized when the anode to cathode voltage is at or very near the positive peak of the AC waveform. The current peak depends upon the impedances of the line (terminals 14 and 16) and the lamp acting in series. To control the time of pulsed ignition of the lamp 10 with respect to the phase of the AC source waveform, an RC timing circuit 48 is provided with comprises resistor 50 and charging capacitor 52 series connected across AC terminals 16 and 14. When timing capacitor 52 charges to a predetermined level, a trigger pulse is applied to the gate, or control terminal, of SCR 44 through a coupling circuit comprising a voltage breakdown diode 54, such as a diac or a semiconductor unilaternal switch (SUS). The value of resistor 50 is adjusted to fire SCR 44 near the positive peak of the AC waveform. The coupling circuit further includes a diode 56 connected, as illustrated, across capacitor 52 to bypass reverse current so as not to gate the diac 54 on the negative half cycle.

The high voltage pulse generator 58 for lamp 12 comprises a pulse transformer 60, a capacitor 62 and an SCR 64. Circuit 58 is oppositely oriented across the AC source from circuit 38. One side of capacitor 62 is connected through a resistor 66 to AC terminal 14, and the other side of capacitor 62 is connected through primary **60*a* of pulse transformer 60 to AC terminal 16. The secondary winding 60*b* is connected between AC terminal 16 and the external electrode 36 mounted adjacent to the envelope of flash lamp 12. SCR 64 is conneced across capacitor 62 and primary 60*a*, with the anode connected to the junction of capacitor 62 and resistor 66 and the cathode connected to AC terminal 16. Hence, when SCR 64 is triggered, a charge built up on capacitor 62 from the AC source is discharged across primary winding 60*a*. As a result, a high voltage pulse is applied to the trigger electrode 36 of lamp 12 from the secondary of pulse transformer 60. This pulsing ionizes the xenon fill gas, and if capacitor 20 is at its fully charged level and the AC source is in the negative half cycle, the anode to cathode voltage provided by the AC source is sufficient to sustain ionization. Lamp 12 will conduct heavily to rapidly discharge capacitor 20. When capacitor 20 is discharged to its minimum level, the voltage across the lamp drops below that necessary to sustain ionization, and lamp 12** is reliably extinguished.

For maximum intensity, lamp 12 should be ionized when the anode to cathode voltage is at or very near the negative peak of the AC waveform. To control the time of pulsed ignition of lamp 12 with respect to the phase of the AC source waveform, an RC timing circuit 68 is provided which comprises resistor 70 and a charging capacitor 72 series connected across AC terminals 14 and 16. Circuit 68 is oriented oppositely from circuit 48 across the AC source. When timing capacitor 72 charges to a predetermined level, a trigger pulse is applied to the gate, or control terminal, of SCR 64 through a coupling circuit comprising diac 74. The value of resistor 70 is adjusted to fire SCR 64 near the negative peak of the AC waveform. The coupling circuit further includes a diode 76 connected, as illustrated, across capacitor 72 to bypass reverse current so as not to gate the diac 74 on the positive half cycle.

The RC time constant of the generator circuits 38 and 58 should be about one-tenth the RC constant of the timing circuits 48 and 68 to assure a faster charge for triggering.

Accordingly, it is clear that lamps 10 and 12 are triggered to flash in alternate sequence whereby capacitor 20 is successively charged and discharged on respective positive and negative half cycles of the AC source.

In order to control the duration of repetitive flashing, a third timing circuit (duration control circuit 78) is connected across the AC source to be energized thereby and also connected to the first timing circuit 48 for controlling the duration of operation thereof. As a result, circuit 78 thereby controls the duration of the period over which trigger pulses are applied to lamp 10 from generator 38. Circuit 78 includes a capacitor 80 series connected along with a switch 82, potentiometer 84, resistor 86, and diode 88 between AC terminals 14 and 16. The circuit also includes a transistor having its emitter and collector connected across capacitor 52 (of timing circuit 48) as illustrated. A diode 92 is connected between the emitter and base of the transistor, and a zener diode 94 is connected between the transistor base and the junction of switch 82 and potentiometer 84. The other terminal of switch 82 (labeled "reset") is connected through a resistor 96 to AC terminal 14.

In operation, with switch 82 closed as indicated for "timed flash", capacitor 80 charges through diode 88, resistor 86 and potentiometer 84. The voltage on capacitor 80 rises exponentially. When the voltage on the zener diode 94 increases to a predetermined threshold value, it conducts. The resulting current is fed to the base of transistor 90 causing it to "turn on". The conducting transistor 90 clamps the voltage on capacitor 52 (of timing circuit 48) well below the firing potential of diac 54. SCR 44 is thus held off and lamp 10 has no triggering signal. With lamp 10 off, lamp 12 cannot fire as its associated capacitor 20 cannot receive a charge. Thus, lamp flashing occurs only while capacitor 80 charges from zero to the threshold voltage of zener diode 94 plus the base-emitter voltage of transistor 90. The timing circuit 78 can then be reset by moving the switch 82 from the "timed flash" terminal to the "reset" terminal, thereby discharging capacitor 80 through resistor 96.

FIG. 2 illustrates an alternative circuit arrangement wherein the lamps are injection triggered. In this instance, the lamps 10 and 12 are injection triggered through respective pulse transformers 100 and 102. The secondary winding **100*b* of pulse transformer 100 is series connected between AC terminal 14 and the anode of lamp 10. The series diode 18 and doubler circuit 22 are not shown in this drawing, although they can be used. The secondary winding 102*b* of pulse transformer 102 is series connected between AC terminal 16 and the cathode of lamp 12. Primary winding 100*a* is connected to a high voltage pulse generator 38', which is the same as the connection of primary 40*a*, in circuit 38 of FIG. 1. Primary winding 102*a* is connected to a high voltage pulse generator 58', which is the same as the connection of primary 60*a* in generator 58 of FIG. 1**.

Although the described circuit can be made using component values in ranges suitable for each particular application, as is well known in the art, the following table lists components values and types for one flash lamp operating circuit made in accordance with the present invention:

| | |
|---|---|
| Diodes 18, 24, 26, 56, 76, 88, 92 | 1N4004 |
| Transistor 90 | 2N4401 |
| Capacitors 20, 30 | 0.1 microfarads, 400 VDC |
| Capacitors 28, 52, 72 | 0.1 microfarads, 250 VDC |
| Capacitors 42 and 62 | 0.22 microfarads, 400 VDC |
| SCR's 44 and 64 | 2N3529 |
| Diodes 54 and 74 | ST-2 |
| Resistors 46 and 66 | 6.2 K ohms, 1/2 watt |
| Resistor 32 | 150 ohms |
| Resistors 50 and 70 | 150K ohms, 1/2 watt |
| Resistor 86 | 100K ohms |
| Resistor 96 | 1,000 ohms, 1/2 watt |
| Potentiometer 84 | 1 megohm |
| Zener diode 94 | 1N821 |
| Capacitor 80 | 10 microfarads, 50VDC |

Although the invention has been described with respect to specific embodiments, it will be appreciated that modifications and changes may be made by those skilled in the art without departing from the true spirit and scope of the invention.

What I claim is:

1. A multilflash operating circuit comprising, in combination:

a source of AC voltage having first and second terminals;

first and second arc discharge flashlamps connected in series with each other;

series circuit means connecting said series connected lamps directly across the first and second terminals of said AC source;

a storage capacitor means connected between the junction of said first and second lamps and the second terminal of said AC source;

respective means for coupling trigger pulses to said first and second lamps; and means connected to and energized by said AC source for generating and alternately applying a succession of high voltage trigger pulses through said respective coupling means to said first and second lamps, each trigger pulse applied to said first lamp effecting an arc path therethrough for charging said capacitor means, and each trigger pulse applied to said second lamp effecting an arc path therethrough for discharging said capacitor means, said charge and discharge producing trigger pulses being generated successively and applied in alternate sequence to said first and second lamps.

2. The circuit of claim 1 wherein said first lamp draws the major portion of operating voltage directly from said AC source with no substantial energy storage means located therebetween other than said storage capacitor means.

3. The circuit of claim 2 wherein said means for generating and alternately applying trigger pulses comprises first and second high voltage pulse generating means connected in respectively opposite orientations across the first and second terminals of said AC source to be energized thereby, the output of each of said high voltage pulse generating means being connected to a respective one of said coupling means, and first and second timing circuits connected in respectively opposite orientations across the first and second terminals of said AC source to be energized thereby and each coupled to a respective one of said high voltage pulse generating means for controlling the time of pulsed ignition of a respective one of said lamps with respect to the phase of the alternating current waveform of said source.

4. The circuit of claim 3 wherein said series circuit means comprises a diode connected in series with said first lamp for assuring that said lamp, when ignited during a half cycle of predetermined polarity of the alternating current waveform of said source, is turned off when said waveform goes to the opposite polarity.

5. The circuit of claim 3 further including a third timing circuit connected across the first and second terminals of said AC source to be energized thereby and connected to said first timing circuit for controlling the duration of operation thereof, said third timing circuit thereby controlling the duration of the period over which trigger pulses are applied to said first lamp, and means for resetting said third timing circuit.

6. The circuit of claim 1 wherein said coupling means is injection triggering means comprising first and second pulse transformers each having primary and secondary windings, the secondary winding of said first pulse transformer being series connected between the first terminal of said AC source and said first lamp, the secondary winding of said second pulse transformer being series connected between the second terminal of said AC source and said second lamp, and said means for generating and applying trigger pulses is connected to the primary windings of said first and second pulse transformers for alternately applying said succession of pulses thereto.

7. The circuit of claim 1 wherein each of said lamps has an envelope, said coupling means is shunt triggering means comprising first and second conductive means respectively adjacent to the envelopes of said first and second lamps, and said means for generating and applying trigger pulses is coupled to said first and second conductive means for alternately applying said succession of pulses thereto.

8. The circuit of claim 1 wherein a voltage doubler is connected across the first and second terminals of said AC source to be energized thereby and connected to said first lamp to assure the ignition thereof when triggered.

* * * * *